United States Patent [19]

Grieshaber et al.

[11] Patent Number: 4,549,511

[45] Date of Patent: Oct. 29, 1985

[54] FUEL INJECTION SYSTEM FOR DIRECT FUEL INJECTION IN INTERNAL COMBUSTION ENGINES

[75] Inventors: Hermann Grieshaber, Stuttgart; Hans-Joachim Siebert, Schwieberdingen, both of Fed. Rep. of Germany

[73] Assignee: Robert Bosch GmbH, Stuttgart, Fed. Rep. of Germany

[21] Appl. No.: 423,579

[22] Filed: Sep. 27, 1982

[30] Foreign Application Priority Data

Dec. 24, 1981 [DE] Fed. Rep. of Germany ..... 3151293

[51] Int. Cl.[4] ..... F02B 23/06

[52] U.S. Cl. ..... 123/263; 123/276; 123/300

[58] Field of Search ..... 123/262, 263, 276, 299, 123/300, 301, 305, 261, 304, 279, 1 A

[56] References Cited

U.S. PATENT DOCUMENTS

| | | | |
|---|---|---|---|
| 1,767,701 | 6/1930 | Riehm | 123/299 X |
| 2,145,640 | 1/1939 | Alden | 123/299 |
| 4,217,871 | 8/1980 | Ohashi et al. | 123/299 X |
| 4,368,702 | 1/1983 | Finsterwalder et al. | 123/299 X |
| 4,463,719 | 8/1984 | Pischinger et al. | 123/276 |

FOREIGN PATENT DOCUMENTS

| | | | |
|---|---|---|---|
| 379453 | 8/1923 | Fed. Rep. of Germany | 123/300 |
| 1050603 | 2/1959 | Fed. Rep. of Germany | 123/299 |
| 2721628 | 12/1977 | Fed. Rep. of Germany . | |
| 2924128 | 12/1980 | Fed. Rep. of Germany | 123/1 A |
| 3002851 | 7/1981 | Fed. Rep. of Germany | 123/1 A |
| 2068460 | 8/1981 | United Kingdom | 123/276 |

*Primary Examiner*—Tony M. Argenbright

*Attorney, Agent, or Firm*—Edwin E. Greigg

[57] ABSTRACT

A fuel injection system is proposed, having a valve each for the pre-injection quantity and for the main injection quantity, each of the valves having plural injection ports. The injection ports for the pre-injection quantity are smaller than those for the main injection quantity. Furthermore, the injection streams of the pre-injection quantity form a cone angle which is smaller than the cone angle of the main injection streams. By means of the two injection pumps it becomes possible to regulate exactly and indepedently the amount of injection as well as the injection time of the pre-injection quantity and of the main injection quantity.

10 Claims, 3 Drawing Figures

FUEL INJECTION SYSTEM FOR DIRECT FUEL INJECTION IN INTERNAL COMBUSTION ENGINES

BACKGROUND OF THE INVENTION

The invention is based on a fuel injection system and a method therefor as described hereinafter. In such a system, known from German Pat. No. 27 21 628, the quantity of pre-injection fuel is introduced into the combustion chambers of an internal combustion engine by way of a special fuel injection valve arrangement in the form of a double valve, separately from the amount of main injection fuel. The pre-injection fuel quantity is controlled by a separate pump arrangement and the main injection fuel quantity by a conventional fuel injection pump. The pre-injection fuel quantity is constant in the known device, but the injection time, i.e. the lead time of the injection over the main injection, can be controlled depending on the load or the rpm.

It has long been known to reduce the noise generation during the operation of a self-igniting internal combustion engine with the aid of a smaller pre-injection quantity preceding the main injection. The harsh combustion noise is created during the use of the common injection devices for self-igniting internal combustion engines because a certain quantity of fuel collects in the combustion chamber in the interval between the onset of injection and the onset of combustion. This quantity is suddenly ignited at the onset of combustion causing a steep rise of the combustion chamber pressure. This very steep rise creates the known hammering noise. On the other hand, however, the injected fuel has sufficient time during the interval between the onset of injection and the onset of combustion to mix well with the air swirling in the combustion chamber. Because of this optimal mixing the fuel consumption of the internal combustion engine is reduced.

If, prior to the injection of the main injection quantity, a small amount of fuel is injected, combustion begins "softly" with this small injection quantity. When the main injection sets in, the ignition temperature required for the introduced fuel has already been reached because of the combustion of the pre-ignition amount. The main injection quantity can then be burned in the combustion chamber as it is injected without a long ignition delay. The combustion pressure curve in such type of combustion is less steep and the noise associated with the combustion is minimal. This injection method, however, has the disadvantage that the main injection mass can no longer intensely mix with the air present in the combustion chamber before the onset of combustion. Fuel consumption and smoke generation in this combustion process are higher than in the process described above.

In the apparatus above-described having a pre-injection pump, the reduction of combustion noise is also achieved at the expense of higher consumption or even generation of smoke.

OBJECT AND SUMMARY OF THE INVENTION

In contrast to the foregoing, the fuel injection system and method in accordance with the present invention has the advantage that because of the method of providing the pre-injection quantity, numerous and locally strong turbulences are created in the combustion chamber which become effective at injection onset or the moment of the main injection. The mixing of the main fuel injection quantity is considerably improved by these local turbulences, especially when the injection valves are disposed as closely as possible to the center of the combustion chamber which is formed as a combustion chamber depression. Because the injection streams of the pre-injection amount form a cone smaller than the cone formed by the streams of the main injection amount, specific local turbulence spots are created at those points in the combustion chamber which are contacted by the fluid stream of the main injection at its onset. By means of these local turbulence spots in the area of the streams of the main injection, a quick and intensive mixing with the combustion air is achieved.

In fuel injection systems with two fuel injection pumps the pre-injection quantity and the pre-injection time are controlled in an especially advantageous manner in dependence from load and rpm conditions. In this way the pre-injection can be optimized with respect to the combustion pressure rise and to the mixing of the main fuel injection quantity.

Furthermore, the injection geometry and the fuel pressure are advantageously synchronized in such a way that the fuel is atomized directly in the combustion chamber. This avoids a wetting with fuel of the combustion chamber walls and achieves total combustion of the fuel during the power stroke.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
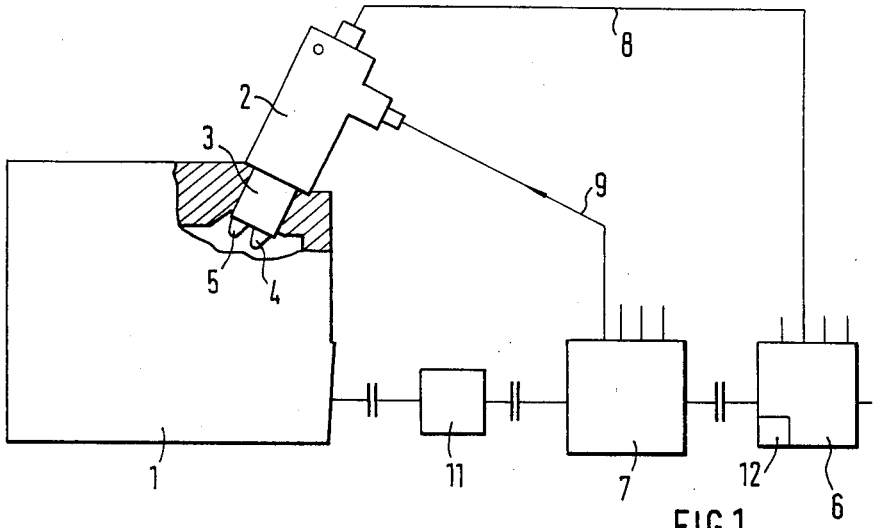
FIG. 1 shows a schematic view of the injection system according to the present invention with a double injection valve and an injection pump each for the main injection and the pre-injection.

An internal combustion engine 1 is schematically shown in FIG. 1, as well as a double injection valve 2 associated with a cylinder of the internal combustion engine. Such injection valves are known from, for instance, German Offenlegungsschrift No. 29 43 895, and need not be further described here. The valve body 3 has a first exit port 4 for the pre-injection quantity and a second exit port 5 for the main injection quantity.

The double injection valve is supplied with fuel by a first fuel injection pump 6 and a second fuel injection pump 7. The first fuel injection pump supplies the fuel to the several double valves of the internal combustion engine via the pre-injection lines 8, and the second fuel injection pump 7 supplies the main fuel injection quantity via the main injection line 9. The second fuel injection pump 7 for the main injection can be embodied as a series-type injection pump, for example, and is connected with the drive of the internal combustion engine via an injection adjustment device 11, such as generally shown in FIG. 1 of U.S. Pat. No. 4,294,211. Furthermore, coupled with the second fuel injection pump 7 is the first fuel injection pump 6, which can be a distributor injection pump with an integrated injection adjuster 12.

With the arrangement described, the main injection quantity as well as the pre-injection quantity can be regulated exactly in relation to time as well as to quantity. The pre-injection quantity and the injection time of the pre-injection quantity are controlled in a known manner in dependence from load and rpm values; quantity and injection time are synchronized with the main injection quantity and its time control. Ratios of injection quantities of 1:1.3 to 1:28 can be set. The onset of injection can be set at 10° to 20° crank angle before the injection onset of the main injection quantity.

Figure 2:
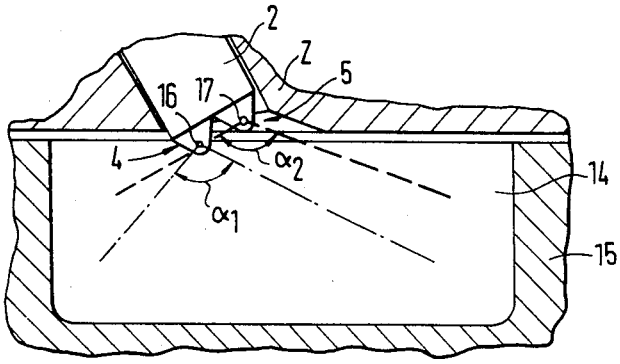
FIG. 2 shows the arrangement of the double injection valve and the direction of the streams in a side elevational view.

In accordance with the present invention the pre-injection quantity is injected into the combustion chamber by means of several injection ports. FIG. 2 shows such a combustion chamber 14, preferably in the shape of a pan, disposed within the piston 15. The double injection valve 2 extends on a slant through the cylinder head into the combustion chamber at a point as close as possible to the center Z of the combustion chamber. Because of the way the double injection valve is constructed, the exit points of the pre-injection quantity and of the main injection quantity are in close proximity of one another. Alternatively, however, other embodiments of double injection valves could be used, instead of being placed side by side they could be disposed coaxially.

Figure 3:
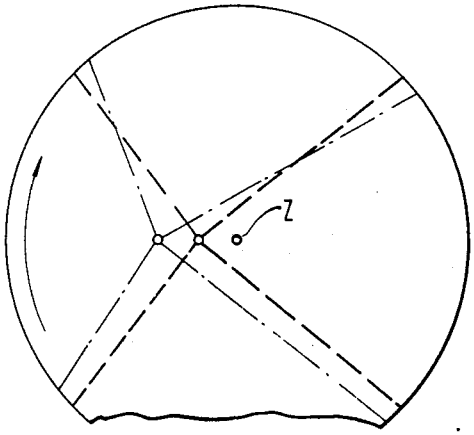
FIG. 3 shows the injection stream distribution in a top plan view.

The double injection valve in the exemplary embodiment has four injection ports 16 at the first exit point 4 together forming a conical angle $\alpha 1$. At the second exit point 5 the double injection valve also has four injection ports 17, which together encompass the conical angle $\alpha 2$. The conical angle $\alpha 2$, in this case, is larger than the conical angle $\alpha 1$. Furthermore, the area of the openings of the injection ports 16 is smaller than the area of the openings of the injection ports 17 in corresponding conformance to the respective quantities of fuel to be injected in each case and in order to obtain an optimum atomization of the fuel. The injection ports 16 and 17 are oriented in such a way that the fuel to be injected is evenly distributed over the area of the combustion chamber, as can be seen in FIG. 3. The spray direction of the pre-injection streams should be orientted in their projection into the combustion chamber 14 so that it is placed ahead of the spray direction of the main injection sprays in the direction of spin of the air in the combustion chamber.

By means of the steps described the combustion noise is reduced with the aid of pre-injection, yet a good mixing with air of the fuel injected is gained nevertheless, both with the pre-injection quantity as well as with the main injection quantity. Furthermore, favorable criteria result in connection with specific fuel consumption, black smoke and exhaust emissions. The mixing with air can be optimized by a corresponding conformance of the injection geometry, for example, the area of the injection openings and the injection pressure. The injection streams should supply the compressed rotating air (because of centrifugal force) in the vicinity of the combustion chamber walls with sufficient fuel. By means of exact regulation it becomes possible to substitute the strength and timing of the numerous local vortexes created by the pre-combustion (secondary vortexes) for the length of mixing otherwise present in the normal ignition delay and no longer present in the main injection.

Thus a "soft" ignition is made possible without having to sacrifice good engine performance based on an efficient mixing of fuel with air.

With proper adaptation and use of dynamic influences it becomes possible to use the fuel injection principle according to the invention with only one fuel injection pump. However, allowance must be made for a separate control device for the determination of the pre-injection quantity and for the determination of the time of injection of the pre-injection quantity.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A fuel injection system for direct fuel injection into combustion chambers of an internal combustion engine having one injection valve injecting a pre-injection quantity into the respective combustion chamber and a further injection valve injecting the main injection quantity into the combustion chamber, wherein the exit points of the fuel of the respective two fuel injection valves are placed adjacent to one another, and having at least one fuel injection pump for the supply of fuel to the injection valves, comprising, plural injection ports (16, 17) in equal numbers for the injection valve for the pre-injection quantity and for the injection valve for the main injection quantity, the area of each of the openings of the injection ports (16) for the pre-injection quantity being smaller than that of the injection ports (17) for the main injection quantity, the injection ports for the pre-injection quantity directing the respective streams thereof to a target area in said combustion chamber common to the respective streams directed from the injection ports for the main injection quantity, and the terminal points for the pre-injection streams being downstream in the direction of swirl in the combustion chamber with respect to the terminal points for the main injection streams.

2. A fuel injection system in accordance with claim 1, wherein the combustion chamber comprises a combustion chamber pan (14) wherein the injection valves (2) are arranged near the center of the combustion chamber.

3. A fuel injection system in accordance with claim 2, wherein the injection streams of the pre-injection quantity form a cone, the conical angle of which is smaller than the conical angle of the injection streams formed by the ports from the main injection quantity.

4. A method for direct fuel injection into combustion chambers of an internal combustion engine having one injection valve injecting a pre-injection quantity into the respective combustion chamber and a further injection valve injecting the main injection quantity into the combustion chamber, wherein the exit points of the fuel of the respective two fuel injection valves are placed adjacent one another, and having at least one fuel injection pump for the supply of fuel to the injection valves, comprising the steps of, forming the pre-injection quantity into streams defining a cone, forming the main injection quantity into streams defining a cone surrounding the cone of the pre-injection quantity, and directing the pre-injection quantity streams ahead of the main-injection quantity streams in the direction of spin of rotating air in the combustion chamber.

5. A method in accordance with either claim 4 wherein the timing of the injection of the pre-injection quantity is dependent on the load and the rpm.

6. A method in accordance with claim 4, wherein the timing of the injection of the pre-injection quantity is controlled dependent from the rpm.

7. A method in accordance with either claim 4, wherein the timing for the injection of the pre-injection quantity is controlled dependent from the load.

8. A method in accordance with either claim 4, wherein the pre-injection quantity is controlled dependent from rpm and load.

9. A method in accordance with claim 4, wherein the pre-injection quantity is controlled dependent from rpm.

10. A method in accordance with claim 4, wherein the pre-injection quantity is controlled dependent from load.

* * * * *